US008097207B2

(12) United States Patent
Beguinot et al.

(10) Patent No.: US 8,097,207 B2
(45) Date of Patent: Jan. 17, 2012

(54) STEEL HAVING HIGH MECHANICAL STRENGTH AND WEAR RESISTANCE

(75) Inventors: Jean Beguinot, Le Creusot (FR); Dominique Viale, Marmagne (FR)

(73) Assignee: Industeel Creusot, Puteaux (FR)

( * ) Notice: Subject to any disclaimer, the term of this patent is extended or adjusted under 35 U.S.C. 154(b) by 0 days.

(21) Appl. No.: 12/776,539

(22) Filed: May 10, 2010

(65) Prior Publication Data

US 2010/0221139 A1 Sep. 2, 2010

Related U.S. Application Data

(63) Continuation of application No. 11/569,379, filed as application No. PCT/FR2005/001191 on May 12, 2005, now Pat. No. 7,794,651.

(30) Foreign Application Priority Data

May 21, 2004 (FR) ..... 04 05535

(51) Int. Cl.
*C22C 38/22* (2006.01)
*C22C 38/44* (2006.01)
*C21D 8/00* (2006.01)

(52) U.S. Cl. ..... 420/110; 420/109; 420/113; 420/115; 420/124; 420/125; 148/333; 148/334; 148/335; 148/328; 148/546; 148/547; 148/548; 75/526; 75/567

(58) Field of Classification Search ..... 148/333–335, 148/328, 546–548; 420/99–101, 109–115, 420/124–126; 75/526, 567
See application file for complete search history.

(56) References Cited

U.S. PATENT DOCUMENTS

| | | | |
|---|---|---|---|
| 4,729,872 | A | 3/1988 | Kishida et al. |
| 2002/0112786 | A1 | 8/2002 | Abe et al. |
| 2003/0066577 | A1 | 4/2003 | Ishida et al. |

FOREIGN PATENT DOCUMENTS

| | | |
|---|---|---|
| DE | 1 273 202 | 7/1968 |
| EP | 805 220 | 11/1997 |
| JP | 57149450 | 9/1982 |

OTHER PUBLICATIONS

Patent Abstracts of Japan, vol. 17, No. 499 (C-1109), Sep. 9, 1993 & JP 05 132738 (Hitachi Ltd.), May 28, 1993.
Patent Abstracts of Japan, vol. 1999, No. 3, Mar. 31, 1999 & JP 10 330894 (Daido Steel Co., Ltd.), Dec. 15, 1998.
Patent Abstracts of Japan, vol. 2000, No. 22, Mar. 9, 2001 & JP 2001 123247 (Daido Steel Co., Ltd.), May 8, 2001.
Patent Abstracts of Japan, vol. 2000, No. 15, Apr. 6, 2001 & JP 2000 345290, (Daido Steel Co., Ltd.), Dec. 12, 2000.

(Continued)

*Primary Examiner* — Deborah Yee
(74) *Attorney, Agent, or Firm* — Sughrue Mion, PLLC

(57) ABSTRACT

Method for reducing the segregated seams of a steel which has high mechanical strength and high wear resistance and whose composition comprises by weight: 0.30%≦C≦1.42%; 0.05%≦Si≦1.5%; Mn≦1.95%; Ni≦2.9%; 1.1%≦Cr≦7.9%; 0.61%≦Mo≦4.4%; optionally V≦1.45%, Nb≦1.45%, Ta≦1.45% and V+Nb/2+Ta/4≦1.45%; less than 0.1% of boron, less than 0.19% of (S+Se/2+Te/4), less than 0.01% of calcium, less than 0.5% of rare earths, less than 1% of aluminum, less than 1% of copper; the balance being iron and impurities resulting from the production operation. The composition further complies with: $800 \leqq D \leqq 1150$ with $D=540(C)^{0.25}+245(Mo+3V+1.5Nb+0.75Ta)^{0.30}+125Cr^{0.20}+15.8Mn+7.4Ni+18Si$. According to the method, the molybdenum is completely or partially replaced with double the proportion of tungsten so that W>0.21%, and Ti, Zr, C are adjusted so that, after adjustment, Ti+Zr/2≧0.2W, (Ti+Zr/2)×C≧0.07, Ti+Zr/2≦1.49% and D is unchanged at approximately 5%. Steel obtained and method for producing a steel workpiece.

16 Claims, 1 Drawing Sheet

OTHER PUBLICATIONS

Patent Abstracts of Japan, vol. 2000, No. 14, Mar. 5, 2001 & JP 2000 328179 (Daido Steel Co., Ltd.), Nov. 28, 2000.

Patent Abstracts of Japan, vol. 2000, No. 02, Feb. 29, 2000, & JP 11 323487 (Sumitomo Metal Ind. Ltd.) Nov. 26, 1999.

Patent Abstracts of Japan, vol. 2000, No. 21, Aug. 3, 2001 & JP 2001 115234 (Daido Steel Co., Ltd.) Apr. 24, 2001.

Patent Abstracts of Japan. vol. 016, No. 190, May 8, 1992 & JP 04 026739 (Sumitomo Metal Ind, Ltd.) Jan. 29, 1992.

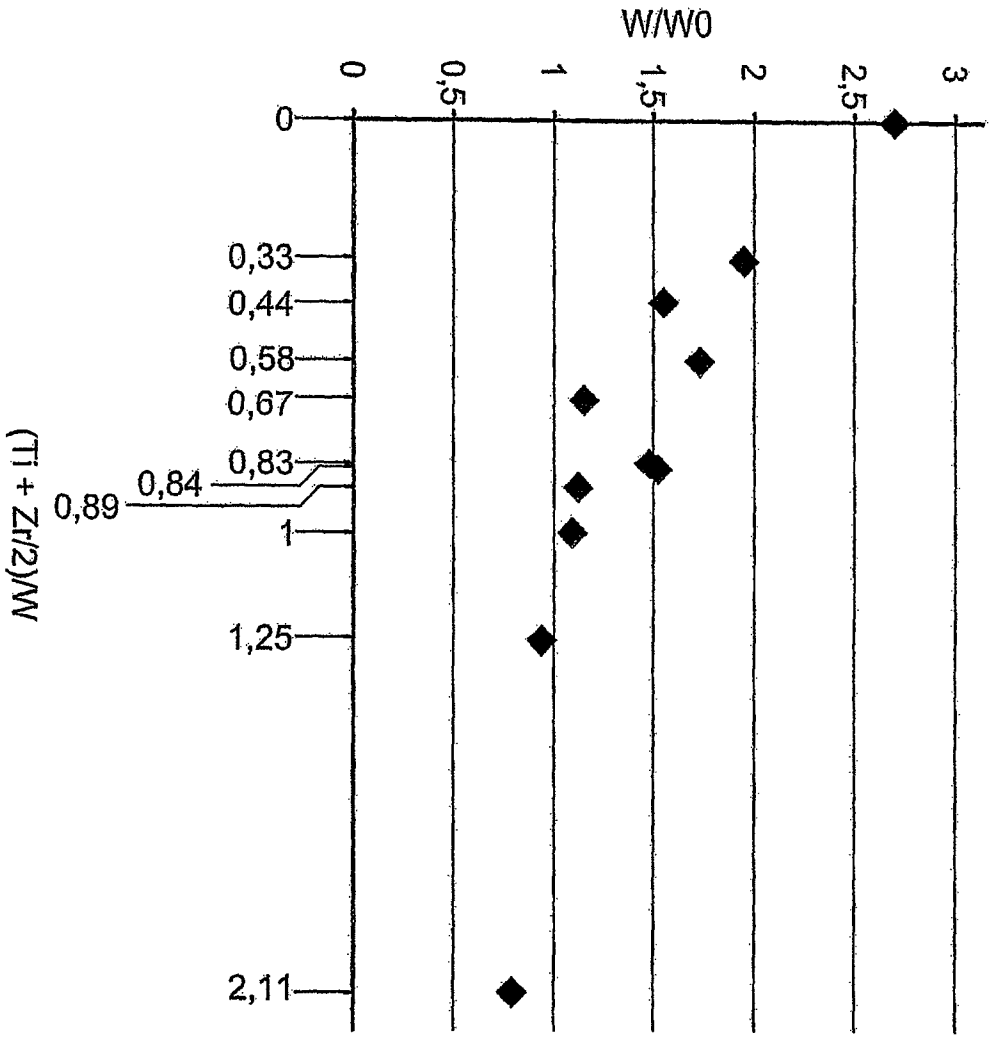
W/W0
3
2,5
2
1,5
1
0,5
0
0
0,33
0,44
0,58
0,67
0,83
0,84
0,89
1
1,25
2,11
(Ti + Zr/2)/W

STEEL HAVING HIGH MECHANICAL STRENGTH AND WEAR RESISTANCE

This is a continuation of application Ser. No. 11/569,379 filed Nov. 20, 2006 now U.S. Pat. No. 7,794,651, which is a §371 of PCT/FR2005/001191 filed May 12, 2005. The entire disclosures of the prior application, application Ser. No. 11/569,379 is considered part of the disclosure of the accompanying continuation application and is hereby incorporated by reference.

The present invention relates to a steel having high mechanical strength and high wear resistance.

In a number of industries, steels having high wear resistance are used. These are, for example, steels which are intended for manufacturing pieces of equipment for mineral industries and which must withstand abrasion. They are also steels which are intended for manufacturing tools for cold-forming or forming at medium temperature metal workpieces and which must withstand wear owing to friction of metal against metal type. For those tooling applications, at least, the steels must retain good properties in spite of being heated to temperatures which may reach 500° C. or 600° C.

In addition to that wear resistance, the steels considered here must have suitable properties in order to be able to be machined or welded. Finally, they must be able to withstand shocks or intense loads.

In general terms, in order to obtain all the desired properties, steels which contain approximately from 0.3% to 1.5% of carbon, less than 2% of silicon, less than 2% of manganese, optionally up to 3% of nickel, from 1% to 12% of chromium, from 0.5% to 5% of molybdenum, with optional addition of vanadium or niobium, are generally used.

In those steels, the wear resistance mainly results from the hardening brought about by the secondary precipitation of molybdenum carbides. The wear resistance can be improved, if necessary, by the presence of coarse ledeburitic carbides which are particularly rich in terms of chromium.

The necessary presence of high contents of strong carbide-producing elements, such as molybdenum and vanadium, which brings about a secondary precipitation which is sufficiently hardening and stable in terms of temperature, does, however, have the disadvantage of leading to the formation of seams which are highly segregated in those elements and in carbon and, consequently, which are very hard and very fragile. Those segregated seams make machining or welding difficult. Furthermore, they constitute fragile zones which, though localized, may substantially reduce the resistance to shocks and intense flexion loads of the workpieces.

The object of the present invention is to overcome that disadvantage by providing a means for obtaining a steel whose properties are equivalent to those of known steels, but whose disadvantageous effect relating to segregated seams is substantially reduced.

To that end, the invention relates to a method for reducing the disadvantageous effect of the segregated seams of a steel which has high mechanical strength and high wear resistance and whose composition comprises by weight:

$$0.30\% \leqq C \leqq 1.42\%$$

$$0.05\% \leqq Si \leqq 1.5\%$$

$$Mn \leqq 1.95\%$$

$$Ni \leqq 2.9\%$$

$$1.1\% \leqq Cr \leqq 7.9\%$$

$$0.61\% \leqq Mo \leqq 4.4\%$$

optionally one or more elements selected from vanadium, niobium and tantalum at contents such that $V \leqq 1.45\%$, $Nb \leqq 1.45\%$, $Ta \leqq 1.45\%$. and $V+Nb/2+Ta/4 \leqq 1.45\%$, optionally up to 0.1% of boron, optionally up to 0.19% of sulphur, up to 0.38% of selenium and up to 0.76% of tellurium, the total S+Se/2+Te/4 remaining less than or equal to 0.19%, optionally up to 0.01% of calcium, optionally up to 0.5% of rare earths, optionally up to 1% of aluminum, optionally up to 1% of copper, the balance being iron and impurities resulting from the production operation. The composition further complies with:

$$800 \leqq D \leqq 1150$$

with:

$$D = 540(C)^{0.25} + 245(Mo+3V+1.5Nb+0.75Ta)^{0.30} + 125Cr^{0.20} + 15.8Mn + 7.4Ni + 18Si$$

According to the method:

the molybdenum is completely or partially replaced with double the proportion of tungsten so that the content W of tungsten is greater than or equal to 0.21%, and there are added titanium and/or zirconium which is/are intended to form, substantially during solidification, coarse carbides, and an additional quantity of carbon 6C equal to Ti/4+Zr/8 so that the content of carbon after adjustment is intended to be equal to C'=C before adjustment+Ti/4+Zr/8.

The added contents of titanium and/or zirconium are such that:

$$Ti+Zr/2 \geqq 0.2 \times W$$

$$(Ti+Zr/2) \times C' \geqq 0.07$$

that is to say, taking into consideration that C'=(C+Ti/4+Zr/8) (where C=content of carbon before adjustment):

$$(Ti+Zr/2) \geqq 2(-C+\sqrt{C^2+0.07})$$

and $$Ti+Zr/2 \leqq 1.49\%$$

The added quantity of carbon δC which initially forms titanium and/or zirconium carbides is no longer available and does not therefore take part in the secondary hardening precipitation of molybdenum, tungsten, vanadium carbides and, secondarily, chromium carbides. That depends on the free carbon C* after adjustment=C'−Ti/4−Zr/8. This results in the hardening of the steel not being modified by the method, apart from dispersion associated with practical dispersions for carrying out observations in steel working. In this regard, it is estimated that the resultant dispersion over factor D does not exceed ±5% so that it is desirable to have:

0.95×D before adjustment≦D after adjustment≦1.05×D before adjustment, where D after adjustment=$540(C'-Ti/4-Zr/8)^{0.25}+245$ (Mo after adjustment+W/2+3V+1.5Nb+0.75Ta)$^{0.30}$+125Cr$^{0.20}$+15.8Mn+7.4Ni+18 Si.

The composition is preferably adjusted so that D after adjustment=D before adjustment.

When the content of chromium is from 2.5 to 3.5%, and if the contents of carbon, titanium and zirconium are such that C≧0.51% before adjustment, the contents of W are preferably limited so that, after adjustment, W≦0.85% if Mo<1.21% and W/Mo≦0.7 if Mo≧1.21%.

The invention also relates to a steel which has high mechanical strength and high wear resistance which is optionally able to be obtained by means of the method according to the invention and whose chemical composition comprises by weight:

0.35%≦C≦1.47%, 0.05%≦Si≦1.5%,

Mn≦1.95%,

Ni≦2.9%, 1.1%≦Cr≦7.9%,

0%≦Mo≦4.29%, 0.21%≦W≦4.9%

0.61%≦Mo+W/2≦4.4%

0%≦Ti≦1.49%

0%≦Zr≦2.9%

0.2%≦Ti+Zr/2≦1.49% optionally one or more elements selected from vanadium, niobium and tantalum, at contents such that V≦1.45%, Nb≦1.45%, Ta≦1.45% and V+Nb/2+Ta/4≦1.45 optionally up to 0.1% of boron, optionally up to 0.19% of sulphur, up to 0.38% of selenium and up to 0.76% of tellurium, the total S+Se/2+Te/4 remaining less than or equal to 0.19%, optionally up to 0.01% of calcium, optionally up to 0.5% of rare earths, optionally up to 1% of aluminium, optionally up to 1% of copper, the balance being iron and impurities resulting from the production operation, the composition complying with the following conditions:

(Ti+Zr/2)/W≧0.20

(Ti+Zr/2)×C≧0.07

0.3%≦C*≦1.42%, and preferably 1.1

800≦D≦1150 with $$D=540(C^*)^{0.25}+245(Mo+W/2+3V+1.5Nb+0.75Ta)^{0.3}+125Cr^{0.20}+15.8Mn+7.4Ni+18Si$$

and $$C^*=C-Ti/4-Zr/8,$$

and furthermore when C* 0.51%, and when 2.5%≦Cr≦3.5%, then W≦0.85% if Mo<1.21%, and W/Mo≦0.7≦si Mo≧1.21%.

Furthermore, the steel may preferably comply with one or more of the following conditions:

Si<0.45%, if it is desirable to give priority to thermal conductivity, or

Si≧0.45%, if it is desirable to give priority to suitability for hot-working, or Mo+W/2≧2.2% in order to increase the resistance to softening of the steel and to confer on it high strength;

Cr≧3.5% in order to contribute both to quenchability and to hardening;

C≦0.85% if it is desirable to give priority to toughness, or

C>0.85% if it is desirable to obtain wear-resistance which is as high as possible.

The steel can further be such that:

Ti+Zr/2<0.7% in order to give priority to toughness, or such that:

Ti+Zr/2≧0.7% in order to give priority to wear-resistance.

The invention also relates to a method for manufacturing a steel workpiece in accordance with the invention, according to which:

a liquid steel is produced having the desired composition with the contents of titanium and/or zirconium in the bath of molten steel being adjusted, preferably with local excess concentrations of titanium and/or zirconium in the bath of molten steel being prevented at all times, the steel is cast in order to obtain a semi-finished product; then the semi-finished product is subjected to a forming processing operation by means of plastic deformation in the hot state and, optionally, a thermal processing operation in order to obtain the workpiece.

In order to limit the transitory excess concentrations in the liquid bath, the addition of titanium and/or zirconium is preferably carried out by progressively adding titanium and/or zirconium to a slag which covers the bath of liquid steel and by allowing the titanium and/or zirconium to diffuse slowly in the bath of liquid steel.

The addition of titanium and/or zirconium can also be carried out by a wire comprising titanium and/or zirconium being introduced into the bath of liquid steel, with the bath being agitated.

Finally, the invention relates to a steel workpiece according to the invention which can be obtained by the production method according to the invention.

The invention will now be described in greater detail, but in a non-limiting manner, and illustrated with reference to examples and the single FIGURE which represents the rate of segregation of tungsten in accordance with the ratio (Ti+Zr/2)/W for various steels.

It is known that tungsten is an alloy element whose effects on the properties of steel are comparable to those of molybdenum. In particular, it is known that tungsten has effects with respect to hardening and resistance to thermal softening which are comparable to those of molybdenum at a proportion of two parts of tungsten per one part of molybdenum. However, tungsten is little used except in some very highly alloyed steels, to which the present invention does not relate, in particular because it is far more expensive than molybdenum. Tungsten, like molybdenum, further has the disadvantage of segregating very strongly and giving rise to very hard and very fragile segregated seams.

The inventors have established, in a novel and surprising manner, that, in the presence of sufficient quantities of titanium or zirconium, the segregation of tungsten is very substantially attenuated: it is particularly advantageous to exploit that effect when, in addition, the content of molybdenum is also already relatively high.

The following hypothesis may clarify a posteriori that unexpected result:

- elements, such as molybdenum and tungsten, form carbides in the form of fine precipitates which harden the matrix and thus allow the desired hardness for the steel to be obtained. The segregated seams which are characterized in particular by excess concentrations of molybdenum or tungsten therefore have a high increase in the density of hardening precipitates and therefore a high local increase in hardness and fragility;
- titanium or zirconium also forms carbides. However, those carbides are relatively coarse and, consequently, comparatively few in number and do not have any significant hardening effect on the metal matrix itself;
- the inventors have established, in a novel and unexpected manner, that, when steel simultaneously contains titanium and/or zirconium, on the one hand, and tungsten, on the other, the tungsten has the tendency to precipitate together with the titanium and/or zirconium in order to form the coarse non-hardening precipitates.

Thus, taking into consideration these observations, it may be thought that, in the presence of titanium and/or zirconium, the content of tungsten and therefore the density of fine precipitates which harden carbides is reduced and, more particularly, in the region of the segregated seams in which the coarse titanium or zirconium carbides are far more numerous, precisely because of the segregation. One consequence would be that the difference in hardness between the segregated seams and the non-segregated zones would thus be substantially attenuated, and the disadvantageous effect of the segregated seams (in particular, the presence of zones of increased fragility, difficulties with respect to machining, heterogeneous response to polishing and granulating, re-surfacing by welding . . . ) would be reduced thereby.

Taking as a basis those observations and the hypothesis which has been set out above, the inventors imagined a method which allows the disadvantages of the segregated seams of steels, which contain a significant proportion of molybdenum, to be substantially reduced whilst retaining all the necessary properties of use of the steel in question.

The method according to the invention relates to a steel which, before the method is carried out, contains principally from 0.30% to 1.42% of carbon, from 0.05% to 1.5% of silicon, less than 1.95% of manganese, less than 2.9% of nickel, from 1.1% to 7.9% of chromium, from 0.61% to 4.4% of molybdenum, optionally up to 1.45% of vanadium, up to 1.45% of niobium, less than 1.45% of tantalum, with $V+Nb/2+Ta/4 \leqq 1.45\%$. That steel has a hardness value D, which will be explained below, of from 800 to 1150. It may further contain up to 0.1% of boron, up to 0.19% of sulphur, up to 0.38% of selenium, up to 0.79% of tellurium, the total $S+Se/2+Te/4$ remaining less than 0.19%, optionally up to 0.01% of calcium, up to 0.5% of rare earths, up to 1% of aluminium and up to 1% of copper.

According to the method, the molybdenum is replaced completely or partially with substantially twice the proportion of tungsten, and titanium and/or zirconium is/are added in order to obtain sufficient quantities of titanium and/or zirconium, taking into consideration the quantities of tungsten introduced in the steel, and the content of carbon is adjusted so that, in particular, the hardness of the steel remains substantially unchanged.

To that end, for example, using the formula which allows the hardness value D which will be explained below to be calculated, or by any other means which is known to the person skilled in the art, the composition which is desired for the steel without tungsten is selected so as to obtain the desired characteristics for use, in particular the level of hardness. Then, the intended composition is modified by selecting a content of tungsten, with the content of molybdenum and the contents of titanium or zirconium and carbon consequently being adjusted, in such a manner that at least one of the main characteristics for use, in particular the hardness, remains substantially unchanged. Then, a steel is produced corresponding to the modified analysis. "Substantially unchanged" is intended to mean, for example, that the hardness of the steel after the composition has been adjusted is equal to the hardness of the steel before the composition was adjusted, to within 5%. That tolerance is introduced in order to take into consideration practical difficulties which there are in producing a steel exactly having properties defined in advance. However, it is desirable for the characteristics obtained to be as similar as possible to the characteristics intended for the steel before the composition is adjusted. Therefore, it is preferable for the tolerance to be only 2%, and, insofar as only the intended characteristics are of interest, it is still more preferable for the intended characteristic of hardness after the composition has been adjusted to be equal to the intended characteristic of hardness before the composition is adjusted.

In the method, the quantity of tungsten added must be greater than or equal to 0.21%, preferably greater than 0.4%, more advantageously greater than 0.7%, and even more advantageously greater than 1.05%. The greater the replacement of molybdenum with tungsten, the more pronounced the effect on the segregations. However, that effect depends on the contents of titanium or zirconium, which generally leads to further limitation of the maximum addition of tungsten.

In order to obtain the desired effect on the segregations, the contents of titanium and zirconium must be such that the total $Ti+Zr/2$ is greater than or equal to $0.2\times W$, preferably greater than or equal to $0.4\times W$, even more advantageously greater than or equal to $0.6\times W$. For reasons which will be set out below, however, it is not desirable to excessively increase the contents of titanium or zirconium. That leads indirectly to limitation of the additions of tungsten to a maximum of 4.9%. In general, the content of tungsten remains less than 2.9%, more advantageously 1.9% or even less than or equal to 0.85%, or 0.49%.

Furthermore, in accordance with the contents of titanium and/or zirconium, the content of carbon must be adjusted so that the content of free carbon $C^*=C'-Ti/4-Zr/8$ remains substantially constant, that is to say, so that the content of free carbon $C^*$ after the composition has been adjusted is substantially equal to the content of carbon C before the composition is adjusted (in this formula, C' represents the content of carbon of the steel after the composition has been adjusted). That condition is necessary in order to keep the hardness and the resistance to thermal softening of the steel substantially constant. It is intended to have the following, with D being the hardness value which will be defined below:

$$0.95\times D \text{ before adjustment} \leqq D \text{ after adjustment} \leqq 1.05\times D \text{ before adjustment},$$

or more advantageously:

$$0.98\times D \text{ before adjustment} \leqq D \text{ after adjustment} \leqq 1.02\times D \text{ before adjustment},$$

or even more advantageously:

$$D \text{ after adjustment} = D \text{ before adjustment}.$$

In practice, the operation for selecting the contents to be adjusted comprises;

selecting the content of tungsten to be substituted for a half-part of molybdenum, in accordance with the desired minimum degree of reduction of segregation (Tables 2, 3, 4 or the FIGURE may serve as a guide in this respect);

selecting the content of Ti and/or Zr so as to be higher or lower in accordance with whether the wear resistance or the toughness is given priority, and which content must further be sufficient with respect to the addition of tungsten because it is necessary for $(Ti+Zr/2) \geqq 0.2$ W.

establishing the increase in carbon to be sought in accordance with the preceding contents, that is to say, $\delta C = Ti/4 + Zr/8$.

The steel in accordance with the invention will now be described, which steel can be obtained by the method according to the invention and which has the advantage of having less disadvantageous segregated seams than those of the steels having the same hardness in accordance with the prior art.

The steel in accordance with the invention contains more than 0.35% of carbon, preferably more than 0.51%, and more advantageously more than 0.65%, in order to be able to form carbides to a sufficient degree and to reach the level of hardness which it is desirable to obtain, but less than 1.47% and preferably less than 1.1% and even more advantageously less than 0.98% in order to avoid embrittling the steel excessively. As has been seen above, the steel contains titanium and zirconium and those elements combine at high temperature with carbon in order to form primary carbides. In that manner, after formation of the primary titanium and zirconium carbides, the so-called "free" carbon which remains available to act on the properties of the matrix is free carbon, which is not combined with titanium and zirconium. This quantity of carbon which is not combined with titanium and zirconium and which is referred to as C*, is such that: $C^* = C - Ti/4 - Zr/8$ (C, Ti and Zr being the contents of steel in terms of carbon, titanium and zirconium, respectively; C will also be referred to hereinafter as "total carbon content"). This available quantity of carbon must be sufficient to allow the precipitation of secondary carbides and in particular tungsten and molybdenum carbides or other elements which are added to the steel, and, from that point of view, the content of free carbon C* must be greater than or equal to 0.3%. However, the content must not exceed 1.42%, and preferably 1.1% or more advantageously 0.98%, or even more advantageously 0.79%, in order not to excessively inhibit the toughness of the matrix itself.

Furthermore, it may be desirable to further limit the maximum total carbon content C to 0.85%, or more advantageously 0.79%, in order to facilitate the production operations, in particular in order to reduce the precautionary measures to be taken for cooling the bars or slabs; it is preferable for the content of free carbon C* to remain less than 0.60%, or 0.50%. Conversely, it may be desirable to select a total carbon content C greater than 0.85%, in order to improve the mechanical strength and the wear resistance of the steel. That selection is made from case to case in accordance with the use which is envisaged for the steel.

The steel contains more than 0.05% of silicon because that element is a deoxidant. Furthermore, it contributes slightly to the hardening of the steel. However, the content of silicon must remain less than or equal to 1.5% and preferably less than or equal to 1.1%, more advantageously 0.9%, and even more advantageously less than or equal to 0.6%, in order to avoid excessively embrittling the steel and excessively reducing its suitability for plastic deformation in the hot state, for example, by means of rolling. Furthermore, it may be desirable to impose a minimum content of silicon of 0.45%, and more advantageously 0.6%, in order to improve the machinability of the steel and also to improve the resistance to oxidation. The improvement in the resistance to oxidation is particularly desirable when the steel is used to manufacture workpieces which are intended to function at relatively high temperatures in the order of from 450° C. to 600° C., which necessitates sufficient resistance to softening. When it is desirable to obtain sufficient resistance to softening for such working conditions, it is desirable for the content of Mo+W/2 to be greater than or equal to 2.2%. Consequently, the minimum values for content of silicon, of 0.45% or more advantageously 0.6%, are more particularly advantageous when the contents of molybdenum and tungsten are such that the total Mo+W/2 is greater than or equal to 2.2%, though without this being of an exclusive nature. For some applications, however, it is desirable for the thermal conductivity of the steel to be as great as possible. In that case, it is desirable for the content of silicon to remain less than 0.45%, and preferably to be as low as possible.

The steel contains up to 1.95% of manganese by weight in order to improve the quenchability of the steel, but that content must preferably remain less than or equal to 1.5% and even more advantageously less than or equal to 0.9% in order to limit the segregations which would lead to poor forgeability and insufficient toughness. It should be noted that the steel still contains a small amount of manganese, a few tenths of a percent, in order in particular to fix the sulphur, and it is preferable for the content of Mn to be at least 0.4%.

The steel contains up to 2.9% of nickel in order to adjust the quenchability and to improve the toughness. However, this element is very expensive. Therefore, a content of nickel greater than 0.9% or even 0.7% is not generally sought. The steel may contain no nickel, but when the nickel is not added voluntarily, it is advantageous for the steel to contain a quantity of nickel of up to 0.2%, or up to 0.4% in the form of residues resulting from the production operation.

The steel contains more than 1.1% of chromium and more advantageously more than 2.1%, and even more advantageously more than 3.1%, and even more than 3.5%, in order to obtain sufficient quenchability and to increase the hardening during tempering, but less than 7.9% and more advantageously less than 5.9% or even more advantageously less than 4.9% in order not to inhibit the formation of secondary carbides, which contain in particular Mo and/or W and, as such, are more effective than chromium carbides in terms of hardening.

Those secondary carbides (that is to say, those formed during cooling after re-austenitization and in particular during the tempering operation(s)), are much more fine and numerous than the ledeburitic carbides (optionally obtained at the end of solidification). Thus, they contribute to a high degree to the hardening of the metal matrix after tempering. They are also advantageous in reinforcing the wear resistance of the matrix, thus limiting the risk of separation of the very hard, coarse titanium and/or zirconium carbides which themselves make a great additional contribution to the wear resistance of the steel.

Within the range of contents of chromium, it is desirable to differentiate two preferred sub-ranges. When the content of chromium is sufficiently high, this element tends to form, in particular in the segregated seams, carbides of the ledeburitic type which are coarse and which are more or less arranged in inter-dendritic networks. Those carbides, in spite of a given advantageous effect on the wear resistance, contribute in particular to at least localized embrittling of the matrix. Consequently, when it is desirable to give priority to the hardness and the wear resistance in preference to the toughness, it is desirable to select a content of chromium which is greater than or equal to 3.5%, promoting the presence of carbides of the ledeburitic type. On the other hand, when it is desirable to promote the toughness of the steel, with a slight reduction in the wear resistance being accepted, it is preferable to select a content of chromium which is less than or equal to 2.5%. However, in the intermediate margin of from 2.5 to 3.5% of chromium, it is further possible to give priority to the toughness, either by the content of free carbon being limited to less than 0.51%, or by the content of tungsten being limited or by the ratio of tungsten to molybdenum being limited, because tungsten, owing to its propensity to form carbides which are more stable in terms of temperature than those of molybdenum, tends to promote the formation of ledeburitic chromium carbides by being preferentially combined therewith.

The contents of molybdenum and tungsten of the steel will have to be such that the total Mo+W/2 is greater than or equal to 0.61%, preferably greater than or equal to 1.1%, and more advantageously greater than or equal to 1.6%. It is even desirable for that content to be greater than 2.2% in order to obtain a high level of hardening, as well as better resistance to thermal softening, in particular when the use of the steel causes it to be heated to temperatures which can exceed approximately 450° C. This is, for example, the case with steels used for producing work tools from the steel at medium temperature. In that case, the total Mo+W/2 may be up to 2.9% or 3.4%, or even 3.9%, in accordance with the desired hardness and the temperature of the tempering which it is desirable to carry out on the workpieces. In order to arrive at a very high level of wear resistance the matrix and to limit to the maximum degree the undermining effect and thus to delay insofar as possible the separation of the coarse carbides of Ti and/or Zr, Mo+W/2 may even be up to 4.4%.

The advantage linked to the increase in the content of (Mo+W/2), that is to say, the content of Molybdenum before the method is applied, makes it all the more advantageous for it to be taken into consideration because the segregation of the Mo carbide-producing substances, apart from the application of the method, increases with the contents of those elements.

Within the scope previously defined for the combined contents of Mo+W/2, the content of tungsten is a minimum of 0.21%, preferably at least 0.41%, even more advantageously at least 0.61%, in order to make best use of the specific effect of tungsten.

The content of tungsten depends on the desired degree of reduction of the disadvantageous effect of the segregations, as indicated above, and may also include the cost of the alloy. That content may be up to 4.9%, but generally does not exceed 1.9%; in general, contents less than or equal to 0.90% or even 0.79% are sufficient.

The content of molybdenum may be at trace level, but is preferably at least equal to 0.51% and, more advantageously, even at least equal to 1.4%; even more advantageously, at least 2.05%. Furthermore, in accordance with the intended level of resistance, it is not necessary to exceed limit contents of 4.29%, preferably 3.4% or, more advantageously, 2.9%, which limitations further allow a further reduction in the contributions of the molybdenum to the hardening segregation.

When the content of chromium is approximately from 2.5% to 3.5%, and when the content of free carbon $C^*=C-Ti/4-Zr/8$ is greater than or equal to 0.51%, however, too high a content of tungsten may lead to the formation of chromium carbides which are more or less combined with the tungsten. Those carbides, which are of the ledeburitic type, coarse and more or less arranged in interdentritic networks, contribute to at least local embrittling of the matrix. In order to overcome that disadvantage, when the content of chromium is from 2.5% to 3.5%, and the content of free carbon $C^*$ is greater than or equal to 0.51%, the content of tungsten is limited to no more than 0.85% when the content of molybdenum is less than 1.21%, and the ratio of tungsten/molybdenum is limited to no more than 0.7 when the content of molybdenum is greater than or equal to 1.21%.

The contents of titanium and zirconium must be adjusted so that the total Ti+Zr/2 is at least 0.21% and preferably greater than or equal to 0.41% or, more advantageously, greater than or equal to 0.61%, in order to obtain the desired effect with respect to reduction of the disadvantageous effect of the segregated seams. Furthermore, the elements contribute to the formation of coarse carbides which improve the wear resistance. However, the total must remain less than 1.49% and preferably less than 1.19%, or less than 0.99% or even less than 0.79%, in order not to inhibit the toughness excessively. Furthermore, the contents of titanium and zirconium must be adjusted according to whether it is desirable to prioritize the toughness of the steel or its wear resistance. From that point of view, when it is desirable to prioritize the toughness of the steel, the total Ti+Zr/2 must preferably remain less than 0.7%. When it is desirable to prioritize the wear resistance of the steel, the total Ti+Zr/2 must preferably be greater than or equal to 0.7%. Finally, in order to be effective, that is to say, to lead to the formation of coarse carbides, the contents of titanium and zirconium must be sufficient with respect to the total content of carbon C. To that end, the product $(Ti+Zr/2)\times C$ must be greater than or equal to 0.07, preferably greater than or equal to 0.12, and, more advantageously, greater than or equal to 0.2.

In order to comply with the ranges of contents indicated for Ti+Zr/2, the minimum content of titanium may be 0%, or trace levels, but it is preferable for it to be at least 0.21%, and, more advantageously, 0.41%, even more advantageously 0.61%; the minimum content of zirconium may be 0%, or trace levels, but it is preferable for it to be at least 0.06%, or more advantageously at least 0.11%. The maximum content of titanium is 1.49% but may be reduced to 1.19%, or to 0.99%, more advantageously to 0.79% or even to 0.7%, whilst the maximum content of zirconium is 2.9%, preferably 0.9%, more preferably 0.49%.

The steel optionally contains up to 1.45% of vanadium, up to 1.45% of niobium, up to 1.45% of tantalum, the total V+Nb/2+Ta/4 being less than 1.45%, more advantageously less than 0.95% and even less than 0.45%. The minimum content is 0% or trace levels, but it is preferable for it to be at least 0.11%, and more advantageously at least 0.21%. The level of addition of V+Nb/2+Ta/4 contributes to fixing the resistance and the response to tempering as indicated in the formula for value D.

The elements have the advantage of greatly improving the resistance to softening by precipitation of carbides of the MC type. From those elements, it is preferable to select vanadium and to add it at contents of from 0.11% to 0.95%. Niobium, though it may be used, has the disadvantage of precipitating at a higher temperature than vanadium, which greatly reduces the forgeability of the steel. Consequently, the presence of niobium is not recommended and, in any case, it is desirable for the content of niobium to remain less than 1% or 0.5% or, even more advantageously, less than 0.05%.

The steel optionally contains up to 0.095%, or even up to 0.19% of sulphur in order to improve machinability; however, a content of less than 0.005% is preferable when good toughness is sought.

In order to obtain an appreciable effect on the response in terms of machining, a minimum content of sulphur of 0.011% or more advantageously 0.051% is desirable.

Sulphur may be completely or partially replaced by double the weight of selenium or four times the weight of tellurium; however, the addition of sulphur, which is more economical, is generally preferred. Furthermore, it may be advantageous to supplement the beneficial action of sulphur on the machinability by adding calcium at a content of up to 0.010%, in order to promote the formation of mixed Mn and Ca sulphides, which are more effective with regard to cutting tools. Therefore, the steel may contain up to 0.38% of selenium, up to 0.76% of tellurium and up to 0.01% of calcium, the total S+Se/2+Te/4 remaining less than or equal to 0.19%.

The steel optionally contains up to 0.5% of rare earths in order to facilitate the nucleation of carbides and to refine the structure, and optionally up to 0.1% of boron in order to improve the quenchability.

The steel may also contain up to 1% of copper. The element is not desirable but may be introduced by means of the raw materials which it would be too expensive to separate. Nevertheless, the content of copper must be limited because the element has an unfavourable effect on the ductility in the hot state. In this respect, the presence of Ni at a content which is at least equal to that of copper is desirable, at least when the content of copper exceeds approximately 0.5%. A sufficient content of nickel attenuates the disadvantageous effect of the copper.

In the same manner, the steel may contain aluminium which, like silicon, may contribute to the deoxidation of the liquid metal. The content of aluminium is at trace level or, more advantageously, at least 0.006%, even more advantageously at least 0.020%. Furthermore, the content of the element must remain less than 1% in order to ensure sufficient purity, and preferably does not exceed 0.100%, and even more advantageously is less than 0.050%.

The balance of the composition is constituted by iron and impurities resulting from the production operation. It should be noted that, when an element is not added voluntarily during the production operation, its content is 0% or trace levels, that is to say, corresponding, depending on the element, either to the limits of detection by analysis methods or to the quantities introduced by way of the raw materials without there being a significant effect on the properties.

The hardening obtained during the tempering of the steel depends on the elements dissolved in the matrix, such as manganese, nickel and silicon, but in particular on the elements which can form carbides, such as molybdenum, tungsten, vanadium, niobium and, to a lesser degree, chromium, as well as the free carbon in the matrix, that is to say, the carbon which has not been fixed by the titanium and by the zirconium. As indicated above, the content of free carbon is $C^*=C-Ti/4-Zr/8$.

The inventors established that the hardening of the steel could be evaluated in accordance with the chemical composition by means of the following formula:

$$D=540(C^*)^{0.25}+245(Mo+W/2+3V+1.5Nb+0.75Ta)^{0.30}+125\times Cr^{0.20}+15.8\times Mn+7.4\times Ni+18\times Si.$$

D is a hardness value which represents the hardening resulting from tempering for standard tempering conditions (550° C. for 1 hour). The higher the value for D, the higher the hardness after tempering at a specific temperature, or the higher the temperature which allows a given level of hardness to be reached.

Furthermore, at a given value for D, the hardness varies in accordance with the temperature and tempering time, as is known to the person skilled in the art.

It should be noted that the formula applies both to the steel according to the invention, or the steel obtained by the method in accordance with the invention, and to the initial steel to which the method in accordance with the invention is applied. In all cases, the contents to be taken into consideration are effective contents of the steel for which the calculation is carried out. That is the reason for which, when the formula is applied to an initial steel which does not contain any tungsten, titanium or zirconium, C* is replaced by C, because C*=C in that case, and the term W/2 disappears because it is 0.

In general terms, the coefficient D is from 800 to 1150. However, the range can be broken down into sub-ranges in accordance with the level of hardness desired by the user and the tempering temperature envisaged. In particular, the value for D is within the following ranges:

from 800 to 900
from 901 to 950
from 951 to 1000
from 1001 to 1075
from 1076 to 1150.

Within those ranges, the typical levels of hardness obtained after tempering at 550° C. for one hour are, by way of indication, in the order of: 45HRC, 52 HRC, 57 HRC, 60 HRC and 63 HRC, respectively.

Taking into consideration all the conditions indicated above, it is possible to select a preferred range for the composition defined as follows, for the steel in accordance with the invention:

$0.55 \leqq C \leqq 1.1\%$ $0.21\% \leqq Ti \leqq 1.19\%$

Zr: 0% or trace levels $0.05\% \leqq Si \leqq 0.9\%$ $Mn \leqq 0.9\%$ $Ni \leqq 0.9\%$ $2.1\% \leqq Cr \leqq 4.9\%$ $2.05\% \leqq Mo \leqq 2.9\%$ $0.21\% \leqq W \leqq 0.79\%$ $0.21\% \leqq V \leqq 0.45\%$ Nb: 0% or trace levels.

Within that range, it is possible to identify sub-ranges, or groups, which are defined by the margins in terms of content of carbon and titanium and which correspond to the fact that the toughness or the wear resistance is prioritized more or less.

Those groups are as follows:

Group A:

$0.85\% \leqq C \leqq 1.1\%$ $0.70\% \leqq Ti \leqq 1.19\%$

Group B:

$0.65\% \leqq C \leqq 1.1\%$ $0.61\% \leqq Ti \leqq 0.99\%$

Group C:

$$0.65\% \leqq C \leqq 0.98\%$$

$$0.41\% \leqq Ti \leqq 0.79\%$$

Group D:

$$0.51\% \leqq C \leqq 0.85\%$$

$$0.21\% \leqq Ti \leqq 0.70\%$$

Within each of those groups, the level of hardness can be adjusted taking into consideration the influences of the various alloy elements indicated by the expression of the hardness value D.

At a given level of hardness, the various groups, in the order A, B, C and D, are arranged in the sense of an increase of the level of toughness at the expense of a reduction in wear resistance.

A particularly advantageous embodiment corresponding to a preferential selection in favour of toughness consists in adjusting the composition in order to obtain:

W=from 0.2 to 0.9% and (Ti+Zr/2) is at least 0.35%, but less than 0.49%, with (Mo+W/2+3V+1.5Nb+0.75Ta) from 2.5%, more advantageously 3.0% in terms of minimum values, to 4.5%, more advantageously 3.5% in terms of maximum values, the free carbon C* further being from 0.51% to 1%, more advantageously from 0.6% to 0.9%.

Another particularly advantageous embodiment corresponding to a preferential selection in favour of the wear resistance consists in adjusting the composition in order to obtain:

W=from 0.2 to 0.9% and (Ti+Zr/2) is at least 0.49%, but less than 0.95%, with (Mo+W/2+3V+1.5Nb+0.75Ta) from 2.5%, more advantageously 3.0% in terms of minimum values, to 4.5%, more advantageously 3.5% in terms of maximum values, the free carbon C* further being from 0.51% to 1%, more advantageously from 0.6% to 0.9%.

According to the present invention, it is desirable for the titanium and zirconium to be in the form of primary carbides and not in the form of nitrides, which are prone to forming in the liquid steel, in particular when transitory excess concentrations of titanium and zirconium in the liquid shortly after the addition are excessively high taking into consideration the contents of dissolved nitrogen which still exists in the liquid steel.

Therefore, in order to produce the steel according to the invention, it is possible to introduce titanium and zirconium in such a manner that those two elements react only slightly with nitrogen and substantially react with the carbon. That is brought about by preventing, during the liquid phase of the steel, transitory excess concentrations of Ti or Zr when Ti and Zr are added In order to manufacture a steel workpiece in accordance with the invention, it is possible to carry out the following steps:

- firstly, a liquid steel is produced by fusion of all the elements of the type according to the invention, with the exception of titanium and/or zirconium,
- then, titanium and zirconium are added to the bath of molten steel, with local excess concentrations of titanium and/or zirconium in the bath of molten steel being prevented at all times.

Then, a steel is cast in the form of a semi-finished product, such as an ingot or a slab, the semi-finished product is formed by plastic deformation in the hot state and, for example, by means of rolling, then the product obtained is subjected to an optional thermal processing operation.

In order to introduce the titanium and zirconium to the liquid steel, with any local excess concentration being prevented, various methods can be carried out, and in particular it is possible:

- to add the titanium and/or zirconium to the slag which covers the bath of liquid steel, allowing the titanium and zirconium to diffuse slowly in the bath of steel;
- to add the titanium and/or zirconium in a continuous manner by means of a wire which is composed of the element(s), with the bath of liquid steel being agitated by gas or by any other suitable method;
- to add the titanium and/or zirconium, with a powder containing the element(s) being blown into the bath of liquid steel, with the bath being agitated by gas or by any other method.

In accordance with the present invention, it is preferable to use the various embodiments which are described above. However, it will be appreciated that any method can be used allowing a local excess concentration of titanium and/or zirconium to be prevented.

However, that specific method for the addition of Ti and Zr is not necessary for the production of the steel in question here, but is instead optional.

The thermal processing operations to which it is possible to subject the workpiece manufactured are of the conventional type for tooling steels. Such a thermal processing operation may optionally comprise one or more annealing operations in order to facilitate cutting and machining, then austenitization followed by cooling according to a method which is adapted to the thickness, such as cooling in air or oil, optionally followed by one or more annealing operations in accordance with the level of hardness which it is desirable to achieve.

By means of the method described above, steel workpieces are obtained having the same principal characteristics for use as steel workpieces according to the prior art. However, these workpieces have segregated seams which are greatly attenuated relative to those which can be seen in workpieces in accordance with the prior art. Consequently, these workpieces are easier to machine or weld and have a toughness higher than workpieces in accordance with the prior art.

By way of example and in order to illustrate the synergetic effect between tungsten and titanium or zirconium, it is possible to produce workpieces in steels whose nominal compositions are set out in Table 1. This Table, which indicates the chemical compositions, the value of hardness coefficient D and a segregation coefficient Γs which takes into consideration the cumulative hardening and embrittling segregation of molybdenum and tungsten in the segregated seams that is capable of producing the secondary hardening. To this end, a microprobe was used to measure the contents of molybdenum and tungsten inside (Mos and Ws) and outside (Moh and Wh) segregated seams with the coarse titanium carbides being suppressed in order to correctly take into consideration the contents of molybdenum and tungsten in the matrix, in addition to that which can be fixed in the coarse titanium and zirconium carbides (which are themselves liable to contain molybdenum or tungsten, forming mixed carbides (Ti Zr Mo W) C). In that manner, the hardening and embrittling part of Mo and W will be appreciated with respect to the metal matrix.

In that manner, the segregation rate Γs MW of the cumulative contents of (Mo+W/2) is defined as being:

$$\Gamma sMW=((Mos+Ws/2)-(Moh+Wh/2))/(Moh+Wh/2).$$

The criterion Mo+W/2 has been retained because it represents the cumulative hardening contribution of the elements Mo and W, both inside segregated seams and outside those seams.

TABLE 1

| | | C | Ti | Zr | C* | Si | Mn | Ni | Cr | Mo | W | V | Nb | Mo + W/2 | D | ΓsMW |
|---|---|---|---|---|---|---|---|---|---|---|---|---|---|---|---|---|
| $a_1$ | comp | 0.31 | 0 | 0 | 0.31 | 0.2 | 0.7 | 0.4 | 3 | 0.75 | 0 | 0.10 | 0 | 0.75 | 825 | 133 |
| $a_2$ | comp | 0.31 | 0 | 0 | 0.31 | 0.2 | 0.7 | 0.4 | 3 | 0.55 | 0.4 | 0.10 | 0 | 0.75 | 825 | 137 |
| $a_3$ | Inv | 0.41 | 0.40 | 0 | 0.31 | 0.2 | 0.7 | 0.4 | 3 | 0.55 | 0.4 | 0.10 | 0 | 0.75 | 825 | 106 |
| $b_1$ | comp | 0.6 | 0.4 | 0 | 0.5 | 0.5 | 0.5 | 0.3 | 6.5 | 2.2 | 0 | 0.3 | 0 | 2.2 | 999 | 128 |
| $b_2$ | comp | 0.75 | 0.8 | 0.4 | 0.5 | 0.5 | 0.5 | 0.3 | 6.5 | 2.2 | 0 | 0.3 | 0 | 2.2 | 999 | 131 |
| $b_3$ | Inv | 0.75 | 0.8 | 0.4 | 0.5 | 0.5 | 0.5 | 0.3 | 6.5 | 1.5 | 1.4 | 0.3 | 0 | 2.2 | 999 | 98 |
| $c_1$ | comp | 0.80 | 0.25 | 0 | 0.74 | 0.9 | 0.45 | 0.25 | 3.9 | 2.1 | 0 | 0.28 | 0 | 2.1 | 1028 | 130 |
| $c_2$ | Inv | 0.80 | 0.25 | 0 | 0.74 | 0.9 | 0.45 | 0.25 | 3.9 | 1.2 | 1.8 | 0.28 | 0 | 2.1 | 1028 | 121 |
| $c_3$ | Inv | 0.95 | 0.85 | 0 | 0.74 | 0.9 | 0.45 | 0.25 | 3.9 | 1.2 | 1.8 | 0.28 | 0 | 2.1 | 1028 | 93 |
| $d_1$ | comp | 1.25 | 1 | 0 | 1 | 1 | 0.5 | 0.2 | 5 | 2.4 | 0 | 0.6 | 0 | 2.4 | 1117 | 127 |
| $d_2$ | Inv | 1.25 | 1 | 0 | 1 | 1 | 0.5 | 0.2 | 5 | 2.0 | 0.8 | 0.6 | 0 | 2.4 | 1117 | 107 |
| $d_3$ | Inv | 1.25 | 1 | 0 | 1 | 1 | 0.5 | 0.2 | 5 | 1.5 | 1.8 | 0.6 | 0 | 2.4 | 1117 | 91 |

Examples $a_1$, $b_1$, $c_1$ and $d_1$ correspond to reference steels, that is to say, steels whose composition is selected before the method according to the invention is carried out. The other examples are derived from those reference steels by means of the method according to the invention, except for examples $a_2$ and $b_2$ for which the conditions relating to tungsten and titanium have not been complied with.

Examples $a_1$, $a_2$ and $a_3$ have the same hardness. Example $a_2$ is derived from example $a_1$ by replacing 0.20% of molybdenum with 0.40% of tungsten, without any addition of titanium. It will be appreciated that the segregation rate is not significantly modified.

Example $a_3$, in accordance with the invention, is derived from example $a_1$ not only by replacing 0.20% of molybdenum with 0.40% of tungsten, but in addition by adding 0.40% of titanium and consequently adjusting carbon. It will be appreciated that the segregation rate of that steel is very substantially reduced relative to that of examples $a_1$ and $a_2$.

In the same manner, examples $b_1$, $b_2$ and $b_3$ show that the addition of titanium and zirconium without any addition of tungsten does not have any effect (comparison $b_1$, $b_2$), whilst the desired effect appears in the presence of tungsten which is partially substituted for molybdenum (comparison $b_2$, $b_3$).

Examples $c_1$, $c_2$ and $c_3$ show that, with equal addition of tungsten, an increase in the addition of titanium has a favourable effect on the segregations.

In the same manner, examples $d_1$, $d_2$, and $d_3$ show that an increase in the content of tungsten has a favourable effect because the contents of titanium or zirconium are sufficient.

In order to illustrate the effect of the ratio (Ti+Zr/2)/W on the segregation of tungsten, it is also possible to consider the examples corresponding to the steels of the reference castings 5, 7, 1, 9, 6, 2, 18, 13, 17 and 3 which all correspond to the invention, except for the reference casting. The contents in terms of principal elements of those castings are set out in Table 2; the balance of the composition being iron and impurities resulting from the production operation.

TABLE 2

| Casting No. | C | Ti | Zr | Si | Mn | Ni | Cr | Mo | W | V | Nb |
|---|---|---|---|---|---|---|---|---|---|---|---|
| Ref | 0.82 | 0 | 0 | 0.35 | 1.15 | 0.25 | 5.00 | 0.90 | 0.57 | 0.11 | 0.00 |
| 5 | 0.37 | 0.20 | 0.00 | 1.00 | 0.50 | 0.20 | 3.00 | 1.50 | 0.60 | 0.20 | 0.00 |
| 7 | 0.62 | 0.55 | 0.21 | 0.50 | 0.40 | 1.20 | 2.20 | 1.00 | 1.50 | 0.20 | 0.15 |
| 1 | 0.37 | 0.35 | 0.00 | 1.00 | 0.50 | 0.20 | 3.00 | 1.50 | 0.60 | 0.20 | 0.00 |
| 9 | 0.75 | 0.80 | 0.40 | 0.50 | 0.50 | 0.30 | 6.50 | 1.40 | 1.50 | 0.30 | 0.00 |
| 6 | 0.50 | 0.50 | 0.00 | 0.40 | 0.60 | 0.20 | 5.00 | 1.20 | 0.60 | 0.25 | 0.10 |
| 2 | 0.41 | 0.42 | 0.00 | 0.20 | 0.70 | 0.40 | 3.00 | 0.40 | 0.50 | 0.10 | 0.00 |
| 18 | 0.95 | 0.85 | 0.00 | 0.90 | 0.45 | 0.25 | 2.10 | 1.60 | 0.95 | 0.28 | 0.00 |
| 13 | 1.00 | 1.00 | 0.00 | 0.60 | 0.60 | 0.20 | 3.80 | 1.00 | 1.00 | 0.25 | 0.20 |
| 17 | 1.25 | 1.00 | 0.00 | 1.00 | 0.50 | 0.20 | 5.00 | 2.40 | 0.80 | 0.60 | 0.00 |
| 3 | 0.55 | 0.95 | 0.00 | 0.25 | 0.70 | 0.30 | 2.50 | 0.45 | 0.45 | 0.10 | 0.00 |

Table 3 shows the total Ti+Zr/2, the contents in terms of W, the ratios (Ti+Zr/2)/W and the relationships Ws/W of the contents in terms of tungsten in the segregated seams having nominal contents of tungsten.

The values of the relationship Ws/W have been set out in the graphic of the FIGURE in accordance with the values of the relationship (Ti+Zr/2)/W.

TABLE 3

| Casting No. | Ti + Zr/2 | W | (Ti + Zr/2)/W | Ws/W |
|---|---|---|---|---|
| ref | 0 | 0.57 | 0 | 2.7 |
| 5 | 0.2 | 0.6 | 0.33 | 1.95 |
| 7 | 0.66 | 1.5 | 0.44 | 1.55 |
| 1 | 0.35 | 0.6 | 0.58 | 1.73 |
| 9 | 1 | 1.5 | 0.67 | 1.15 |
| 6 | 0.5 | 0.6 | 0.83 | 1.48 |
| 2 | 0.42 | 0.5 | 0.84 | 1.52 |
| 18 | 0.85 | 0.95 | 0.89 | 1.12 |
| 13 | 1 | 1 | 1 | 1.09 |
| 17 | 1 | 0.8 | 1.25 | 0.94 |
| 3 | 0.95 | 0.45 | 2.11 | 0.79 |

The graphic shows that the relationship Ws/W becomes substantially less than 2 as soon as the relationship (Ti+Zr/2)/W exceeds 0.2. It can also be seen that Ws/W decreases regularly when (Ti+Zr/2)/W increases, whilst it is 2.7 for the reference casting which does not contain any titanium or zirconium.

The invention is also illustrated by the examples corresponding to the analyses indicated in Table 4 which also indicates the relationship Ws/W which, in all cases, is less than 1.6 and may even be as little as 0.67.

TABLE 4

| Casting No. | C | Ti | Zr | Si | Mn | Ni | Cr | Mo | W | V | Nb | Ws/W |
|---|---|---|---|---|---|---|---|---|---|---|---|---|
| 21 | 0.82 | 0.41 | tr | 0.9 | 0.6 | 1.5 | 2.7 | 2.2 | 0.5 | 0.25 | tr | 1.51 |
| 22 | 0.95 | 0.83 | 0.2 | 0.8 | 0.6 | 0.2 | 4.1 | 2.3 | 0.3 | 0.25 | tr | 0.67 |
| 23 | 0.94 | 0.92 | tr | 0.7 | 1.3 | 0.2 | 3.2 | 2.5 | 0.5 | 0.4 | tr | 0.84 |
| 24 | 0.81 | 0.42 | tr | 0.9 | 0.8 | 0.2 | 4.4 | 1.4 | 0.7 | 0.15 | 0.20 | 1.65 |
| 25 | 0.72 | 0.4 | tr | 0.9 | 0.3 | 0.2 | 5.5 | 1.6 | 0.5 | 0.15 | tr | 1.52 |
| 26 | 0.79 | 0.71 | 0.4 | 0.9 | 0.6 | 0.2 | 4.4 | 1.5 | 0.5 | 0.15 | tr | 0.85 |
| 27 | 1.02 | 0.38 | tr | 0.9 | 0.9 | 0.3 | 2.1 | 1.5 | 0.5 | 0.15 | tr | 1.54 |
| 28 | 0.8 | 0.44 | tr | 0.2 | 0.6 | 1.4 | 2.7 | 2.1 | 0.5 | 0.25 | tr | 1.42 |
| 29 | 0.95 | 0.85 | tr | 0.3 | 0.6 | 0.2 | 4.0 | 2.3 | 0.4 | 0.20 | tr | 0.77 |
| 30 | 0.95 | 0.88 | tr | 0.2 | 1.4 | 0.2 | 3.1 | 2.6 | 0.5 | 0.4 | tr | 0.83 |
| 31 | 0.8 | 0.42 | tr | 0.3 | 0.9 | 2.1 | 4.7 | 1.5 | 0.7 | 0.15 | tr | 1.57 |
| 32 | 0.7 | 0.4 | tr | 0.3 | 0.3 | 1.2 | 3.5 | 1.4 | 0.5 | 0.15 | 0.25 | 1.47 |
| 33 | 0.8 | 0.9 | tr | 0.2 | 0.4 | 0.3 | 3.2 | 1.5 | 0.5 | 0.15 | tr | 0.82 |
| 34 | 1 | 0.44 | tr | 0.5 | 0.4 | 0.2 | 4.5 | 1.2 | 0.5 | 0.15 | tr | 1.44 |
| 35 | 0.71 | 0.41 | tr | 0.4 | 1.6 | 0.2 | 6.1 | 1.2 | 0.5 | 0.75 | tr | 1.46 |
| 36 | 0.91 | 0.92 | tr | 0.1 | 0.9 | 0.4 | 5.7 | 0.6 | 0.8 | 0.65 | tr | 1.03 |
| 37 | 1.25 | 0.95 | tr | 0.9 | 0.6 | 1.7 | 4.1 | 3.1 | 0.9 | 0.35 | 0.35 | 1.03 |

These examples also show the effect of the content of silicon on the thermal conductivity of the steel and therefore the advantage which there is in imposing a low content of silicon when the steel is intended to produce tools for which good thermal conductivity is desired. This effect is illustrated by the pairs of examples 21 and 28, 22 and 29, 23 and 30. In each of those pairs, the examples substantially differ only in terms of the contents of silicon. The thermal conductivity levels are as follows:

| | | |
|---|---|---|
| Example n° 21: | Si = 0.9% | thermal conductivity = 20.6 W/m/K |
| Example n° 28: | Si = 0.2% | thermal conductivity = 25.1 W/m/K |
| Example n° 22: | Si = 0.8% | thermal conductivity = 21.3 W/m/K |
| Example n° 29: | Si = 0.3% | thermal conductivity = 24.4 W/m/K |
| Example n° 23: | Si = 0.7% | thermal conductivity = 20.7 W/m/K |
| Example n° 30: | Si = 0.2% | thermal conductivity = 23.6 W/m/K |

In this manner, it can be seen that a low level of silicon allows the thermal conductivity to be significantly increased. In the case of the examples, the increase is from approximately 15% to approximately 25%.

The invention claimed is:

1. Method for reducing the disadvantageous effect of the segregated seams of a steel which has high mechanical strength and high wear resistance and whose composition consists of, in % by weight:

$0.30\% \leqq C \leqq 0.93\%$ $0.05\% \leqq Si \leqq 1.5\%$ $Mn \leqq 1.95\%$ $Ni \leqq 2.9\%$ $1.1\% \leqq Cr \leqq 7.9\%$ $0.61\% \leqq Mo \leqq 4.4\%$ optionally one or more elements selected from vanadium, niobium and tantalum at contents such that $V \leqq 1.45\%$, $Nb \leqq 1.45\%$, $Ta \leqq 1.45\%$ and $V+Nb/2+Ta/4 \leqq 1.45\%$, optionally up to 0.1% of boron, less than 0.005% of sulphur, optionally up to 0.01% of calcium, optionally up to 0.5% of rare earths, optionally up to 1% of aluminum, optionally up to 1% of copper, the balance being iron and impurities resulting from the production operation, the composition further complying with:

$$800 \leqq D \leqq 1150$$

with:

$$D=540(C)^{0.25})+245(Mo+3\,V+1.5\,Nb+0.75\,Ta)^{0.30}+125\,Cr^{0.20}+15.8\,Mn+7.4\,Ni+18\,Si$$

according to which method:

the molybdenum is completely or partially replaced with double the proportion of tungsten so that the content of tungsten is greater than or equal to 0.21%, the contents of titanium and/or zirconium are added such that, if C' is the content of carbon after adjustment and C is the content of carbon before adjustment:

$$Ti+Zr/2 \geqq 0.20 \times W$$

$$C'=C+Ti/4+Zr/8$$

$$(Ti+Zr/2) \times C' \geqq 0.07$$

and $Ti+Zr/2 \leqq 1.49\%$, the precision for carrying out those analytical adjustments at the steel works being such that:

$$0.95 \times D \text{ before adjustment} \leqq D \text{ after adjustment} \leqq 1.05 \times D \text{ before adjustment},$$

with:

$$D \text{ after adjustment}=540(C'-Ti/4-Zr/8)^{0.25}+245(Mo \text{ after adjustment}+W/2+3V+1.5Nb+0.75\,Ta)^{0.30}+125\,Cr^{0.20}+15.8\,Mn+7.4\,Ni+18\,Si.$$

2. Method according to claim 1, wherein, when the content of chromium is from 2.5% to 3.5%, if the content of carbon, before adjustment of the composition is such that $C \leqq 0.51\%$, then $W \leqq 0.85\%$ if Mo after adjustment<1.21% and W/Mo 0.7 if Mo after adjustment$\geqq$1.21%.

3. Method according to claim 1, wherein:

D after adjustment=D before adjustment.

4. Steel which has high mechanical strength and high wear resistance and whose chemical composition consists of in % by weight:

$0.35\% \leqq C \leqq 0.98\%$, $0.05\% \leqq Si \leqq 1.5\%$, $Mn \leqq 1.95\%$, $Ni \leqq 2.9\%$, $1.1\% \leqq Cr \leqq 7.9\%$, $0\% \leqq Mo \leqq 4.29\%$, $0.21\% \leqq W \leqq 4.9\%$ $0.61\% \leqq Mo+W/2 \leqq 4.4\%$ $0\% \leqq Ti \leqq 1.49\%$ $0\% \leqq Zr \leqq 2.9\%$ $0.21\% \leqq Ti+Zr/2 \leqq 1.49\%$ optionally one or more elements selected from vanadium, niobium and tantalum, at contents such that $V \leqq 1.45\%$, $Nb \leqq 1.45\%$, $Ta \leqq 1.45\%$ and $V+Nb/2+Ta/4 \leqq 1.45\%$, optionally up to 0.1% of boron, less than 0.005% of sulphur, optionally up to 0.01% of calcium, optionally up to 0.5% of rare earths, optionally up to 1% of aluminum, optionally up to 1% of copper, the balance being iron and impurities resulting from the production operation, the composition complying with the following conditions:

$(Ti+Zr/2)/W \geqq 0.20$ $(Ti+Zr/2) \times C \geqq 0.07$ $0.3\% \leqq C^* \leqq 0.93\%$ $800 \leqq D \leqq 1150$ with $$D=540(C^*)^{0.25}+245(Mo+W/2+3V+1.5Nb+0.75Ta)^{0.3}+125Cr^{0.20}+15.8Mn+7.4Ni+18Si$$

and $$C^*=C-Ti/4-Zr/8,$$

and, furthermore, when $C^* \leqq 0.51\%$ and $2.5\% \leqq Cr \leqq 3.5\%$, then $W \leqq 0.85\%$ if $Mo<1.21\%$ and $W/Mo \leqq 0.7$ if $Mo \geqq 1.21\%$.

5. Steel according to claim 4, wherein:

$W \leqq 0.85\%$.

6. Steel according to claim 4, wherein:

$Si \geqq 0.45\%$.

7. Steel according to claim 4, wherein:

$Si<0.45\%$.

8. Steel according to claim 4, wherein:

$Mo+W/2 \geqq 2.2\%$.

9. Steel according to claim 4, wherein:

$Cr \geqq 3.5\%$.

10. Steel according to claim 4, wherein:

$C>0.85\%$.

11. Steel according to claim 4, wherein:

$Ti+Zr/2<0.7\%$.

12. Steel according to claim 4, wherein:

$Ti+Zr/2 \geqq 0.7\%$.

13. Method for producing a steel workpiece according to claim 4, wherein:

a liquid steel is produced having the desired composition with the contents of titanium and/or zirconium in the bath of molten steel being adjusted, with local excess concentrations of titanium and/or zirconium in the bath of molten steel being prevented at all times;

the steel being cast in order to obtain a semi-finished product;

then, the semi-finished product is subjected to a forming processing operation by means of plastic deformation in the hot state and, optionally, a thermal processing operation in order to obtain the workpiece.

14. Method according to claim 13, wherein the addition of titanium and/or zirconium is carried out by progressively adding titanium and/or zirconium to a slag which covers the bath of liquid steel and by allowing the titanium and/or zirconium to diffuse slowly in the bath of liquid steel.

15. Method according to claim 13, wherein the addition of titanium and/or zirconium is carried out by a wire comprising titanium and/or zirconium being introduced into the bath of liquid steel, with the bath being agitated.

16. A workpiece of the steel according to claim 4, which workpiece is obtained by a method wherein:

a liquid steel is produced having the desired composition with the contents of titanium and/or zirconium in the bath of molten steel being adjusted, with local excess concentrations of titanium and/or zirconium in the bath of molten steel being prevented at all times;

the steel being cast in order to obtain a semi-finished product;

then, the semi-finished product is subjected to a forming processing operation by means of plastic deformation in the hot state and, optionally, a thermal processing operation in order to obtain the workpiece.

* * * * *